US009179776B2

(12) United States Patent
Huang

(10) Patent No.: US 9,179,776 B2
(45) Date of Patent: Nov. 10, 2015

(54) HEIGHT ADJUSTMENT MECHANISM FOR CHAIR ARMREST AND DRIVING BLOCK THEREOF

(71) Applicant: Yi-Jen Huang, Changhua (TW)

(72) Inventor: Yi-Jen Huang, Changhua (TW)

( * ) Notice: Subject to any disclaimer, the term of this patent is extended or adjusted under 35 U.S.C. 154(b) by 0 days.

(21) Appl. No.: 14/319,970

(22) Filed: Jun. 30, 2014

(65) Prior Publication Data

US 2015/0115683 A1 Apr. 30, 2015

(30) Foreign Application Priority Data

Oct. 25, 2013 (TW) ..... 102219972 U

(51) Int. Cl.
*A47C 1/03* (2006.01)

(52) U.S. Cl.
CPC ..... *A47C 1/03* (2013.01)

(58) Field of Classification Search
CPC ..... A47C 1/03
USPC ..... 297/353, 411.36
See application file for complete search history.

(56) References Cited

U.S. PATENT DOCUMENTS

| | | | | |
|---|---|---|---|---|
| 5,895,095 | A * | 4/1999 | Chen | 297/411.36 |
| 6,837,545 | B1 * | 1/2005 | Ho | 297/411.36 |
| 7,533,939 | B2 * | 5/2009 | Fookes et al. | 297/353 |
| 7,980,632 | B2 * | 7/2011 | Pai | 297/411.36 |
| 8,128,171 | B2 * | 3/2012 | Tsai | 297/411.36 |
| 8,596,598 | B2 * | 12/2013 | Lai et al. | 248/423 |
| 8,777,318 | B2 * | 7/2014 | Chen | 297/411.36 |
| 2008/0296955 | A1 * | 12/2008 | Geister et al. | 297/411.36 |

* cited by examiner

*Primary Examiner* — Peter Brown

(57) ABSTRACT

A height adjustment mechanism for a chair armrest contains: an inner tube, an adjusting member, an outer tube, a driving block, a fixing member, and a resilient element. The inner tube includes a base, an accommodating groove, and an elongated hole. The adjusting member includes a guiding slot, two toothed racks, and a plurality of guide teeth, wherein each guide tooth has a first crown portion, a first root portion, and a first bottom face. The outer tube includes a support plate an orifice. The driving block includes a pressing portion, two flanges, and plural positioning teeth, wherein a number of the plural positioning teeth is less than that of the plurality of guide teeth. The fixing member includes a first segment and a second segment. The resilient element is fixed in the inner tube and includes a first end abutting against the driving block and the fixing member.

4 Claims, 8 Drawing Sheets

HEIGHT ADJUSTMENT MECHANISM FOR CHAIR ARMREST AND DRIVING BLOCK THEREOF

FIELD OF THE INVENTION

The present invention relates to furniture, and more particularly to a height adjustment mechanism for a chair armrest and a driving block thereof which is operated in a stepless adjusting manner.

BACKGROUND OF THE INVENTION

Chair armrests are fixed on two sides of a chair and are employed to adjust a height of the chair armrests. A conventional height adjustment mechanism is in a step adjusting type or a stepless adjusting type, wherein when the conventional height adjustment mechanism is in a step adjusting type, it contains an inner tube with two racks and an outer tube with plural adjustment teeth for meshing with the two racks, thus adjusting the chair armrests toward a desired height. However, a pith of each adjustment teeth is too large, so an adjusting range is limited. Moreover, when the conventional height adjustment mechanism is in a stepless adjusting type, it contains an inner tube, an outer tube, and a forcing element, such that the forcing element forces the inner tube and the outer tube to adjust the chair armrests toward a desired height. Nevertheless, the inner tube and the outer tube cannot be fixed securely.

The present invention has arisen to mitigate and/or obviate the afore-described disadvantages.

SUMMARY OF THE INVENTION

The primary object of the present invention is to provide a height adjustment mechanism for a chair armrest and a driving block thereof which is adjusted to a desired height smoothly by ways of a second crown portion of a driving block and a plurality of guide teeth of an adjusting member in a stepless adjusting manner.

To obtain the above objectives, a height adjustment mechanism for a chair armrest provided by the present invention contains: an inner tube, an adjusting member, an outer tube, a driving block, a fixing member, and a resilient element.

The inner tube includes a base disposed on a bottom end thereof, an accommodating groove longitudinally defined on a first side thereof, and an elongated hole vertically formed on a second side thereof.

The adjusting member is mounted in the accommodating groove of the inner tube and includes a guiding slot longitudinally arranged thereon, two toothed racks formed on two sides of the guiding slot, and a plurality of guide teeth arranged on the two toothed racks. Each guide tooth has a first crown portion defined on a top end thereof and formed in an arc shape, a first root portion extending between the top end and a bottom end of each guide teeth, and a first bottom face arranged on the bottom end thereof. The first root portion of each guide tooth has two first arcuate sections extending outwardly from two sides of a bottom end thereof, and the first crown portion of each guide tooth has two first tilted faces extending on two sides thereof.

The outer tube is fitted on the inner tube and includes a support plate fixed on a top end thereof and an orifice formed on a first side thereof.

The driving block includes a pressing portion secured on one end thereof and extending out of the orifice of the outer tube, two flanges extending outwardly from two sides of the pressing portion and corresponding to the two toothed racks, and plural positioning teeth disposed on two sides of the two flanges and engaging with the plurality of guide teeth. A number of the plural positioning teeth is less than that of the plurality of guide teeth, each positioning tooth has a second crown portion, a second root portion extending between a top end and a bottom end thereof, and a second bottom face. The second root portion has two second arcuate sections extending outwardly from two sides of a bottom end thereof, the second crown portion has a top face in an arc shape, and the second crown portion has two second tilted faces extending on two sides thereof.

The fixing member is accommodated in the inner tube and includes a first segment and a second segment. The first segment is inserted through the elongated hole of the inner tube to retain in a second end of the outer tube opposite to the second end of the outer tube.

The resilient element is fixed in the inner tube and includes a first end and a second end which abut against the driving block and the fixing member, wherein between the fixing member and the driving block is defined a compressing space which is larger than or equal to a depth of each positioning tooth.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
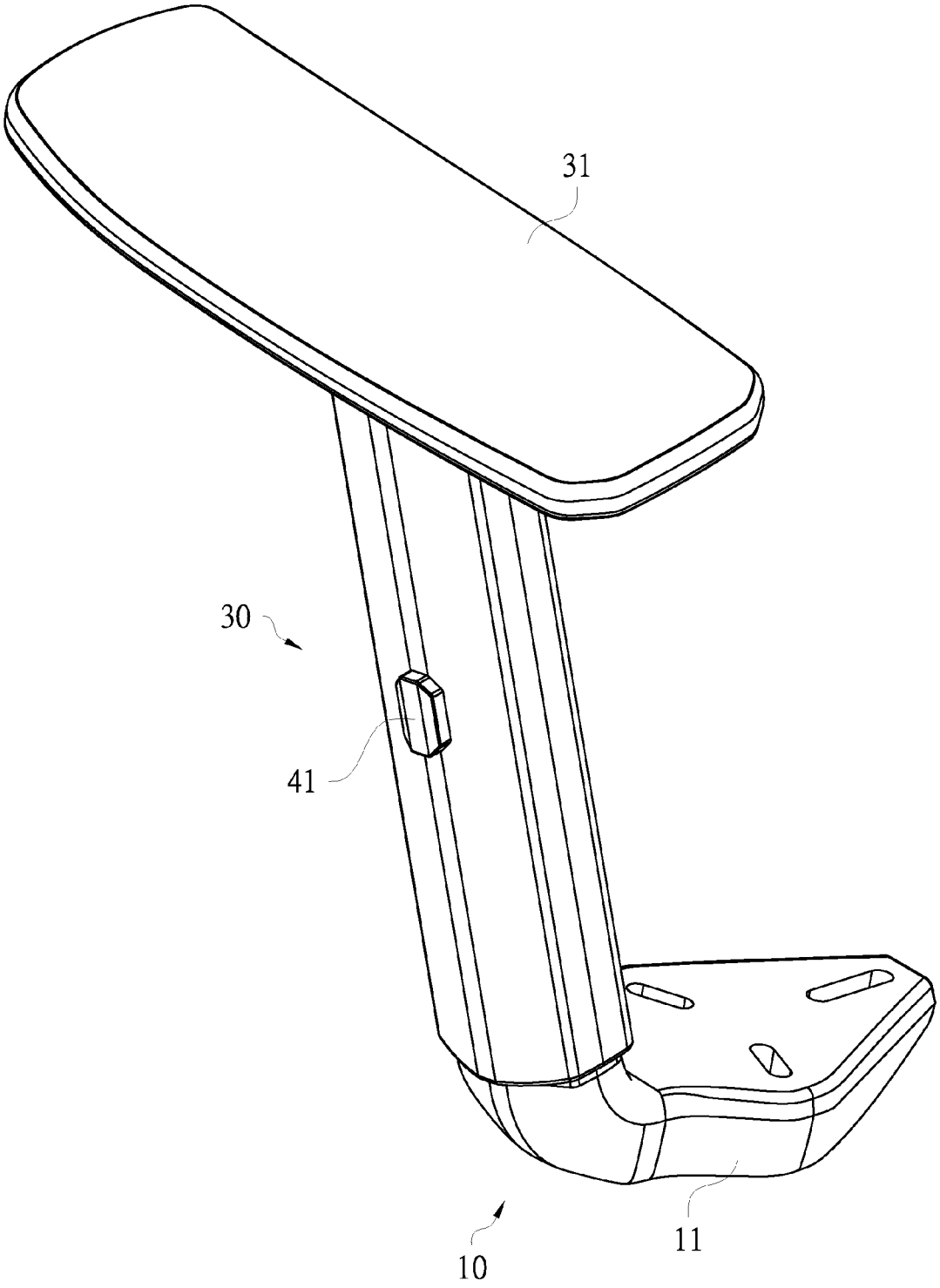
FIG. 1 is a perspective view showing the assembly of a height adjustment mechanism for a chair armrest and a driving block thereof according to a preferred embodiment of the present invention.
Figure 2:
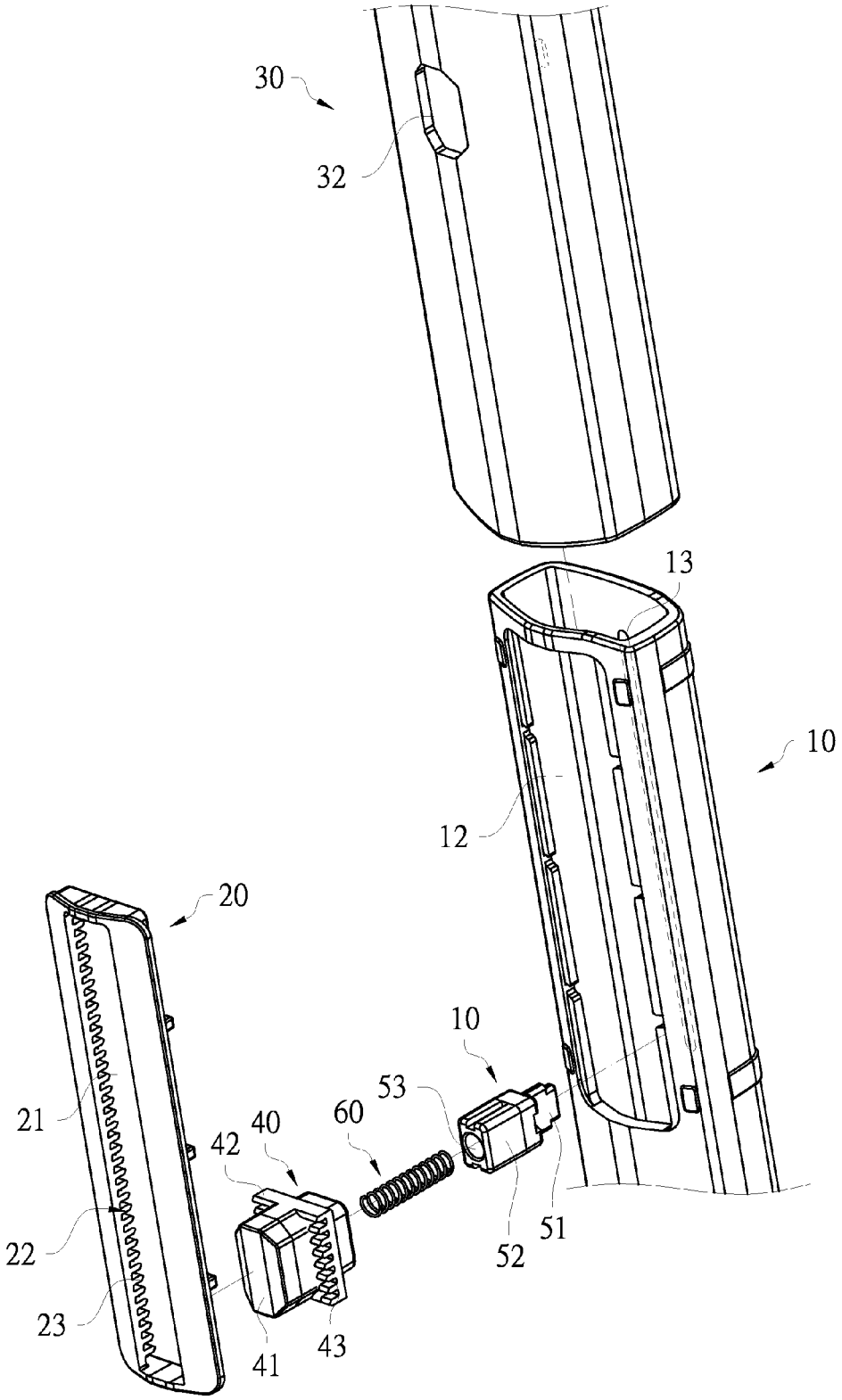
FIG. 2 is a perspective view showing the exploded components of a part of the height adjustment mechanism for the chair armrest and the driving block thereof according to the preferred embodiment of the present invention.
Figure 3:
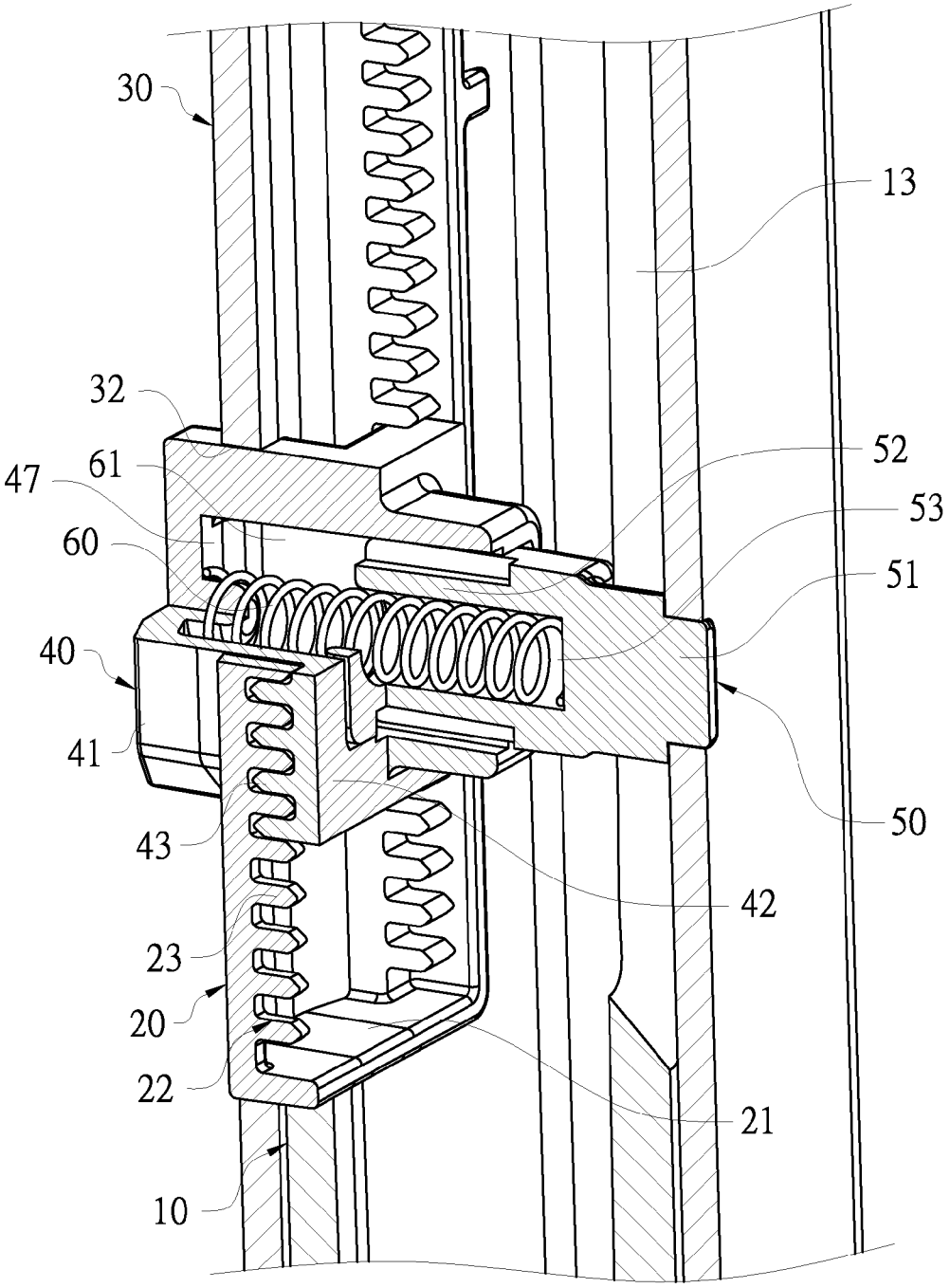
FIG. 3 is a cross-sectional perspective view showing the assembly of a part of the height adjustment mechanism for the chair armrest and the driving block thereof according to the preferred embodiment of the present invention.

With reference to FIGS. 1 to 3, a height adjustment mechanism for a chair armrest and a driving block thereof according to a preferred embodiment of the present invention comprises: an inner tube 10, an adjusting member 20, an outer tube 30, a driving block 40, a fixing member 50, and a resilient element 60.

The inner tube 10 includes a base 11 disposed on a bottom end thereof and connected with a chair cushion (not shown), an accommodating groove 12 longitudinally defined on a first side thereof, and an elongated hole 13 vertically formed on a second side thereof.

The adjusting member 20 is mounted in the accommodating groove 12 of the inner tube 10 and includes a guiding slot 21 longitudinally arranged thereon, two toothed racks 22 formed on two sides of the guiding slot 21, and a plurality of guide teeth 23 arranged on the two toothed racks 22, wherein each guide tooth 23 has a first crown portion defined on a top end thereof and formed in an arc shape, a first root portion extending between the top end and a bottom end of each guide teeth 23, and a first bottom face arranged on the bottom end thereof, wherein the first root portion of each guide tooth 23 has two first arcuate sections extending outwardly from two sides of a bottom end thereof, and the first crown portion of each guide tooth 23 has two first tilted faces extending on two sides thereof.

The outer tube 30 is fitted on the inner tube 10 and includes a support plate 31 fixed on a top end thereof and an orifice 32 formed on a first side thereof.

Figure 4:
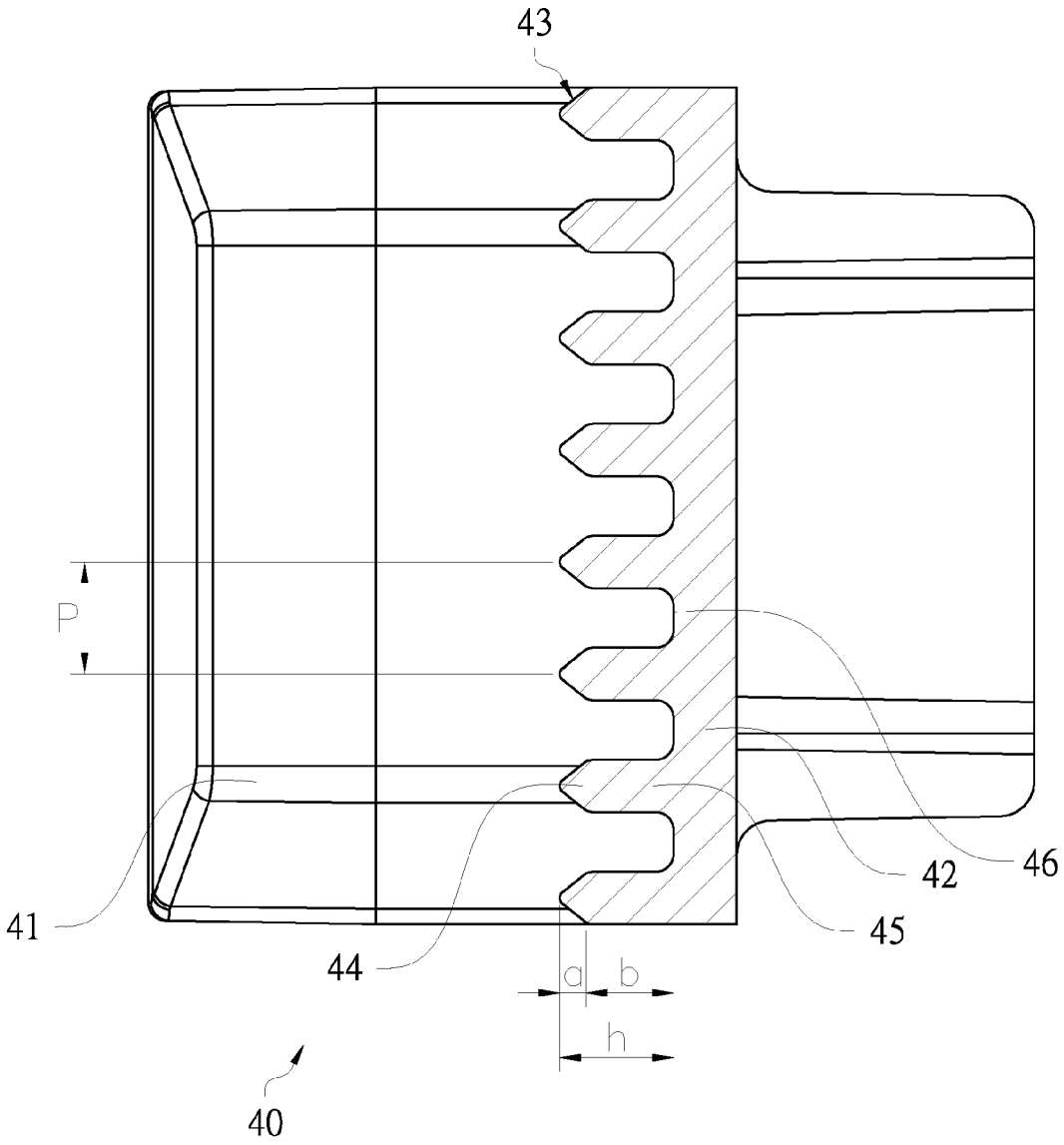
FIG. 4 is an amplified cross-sectional view showing the assembly of a part of the driving block according to the preferred embodiment of the present invention.
Figure 8:
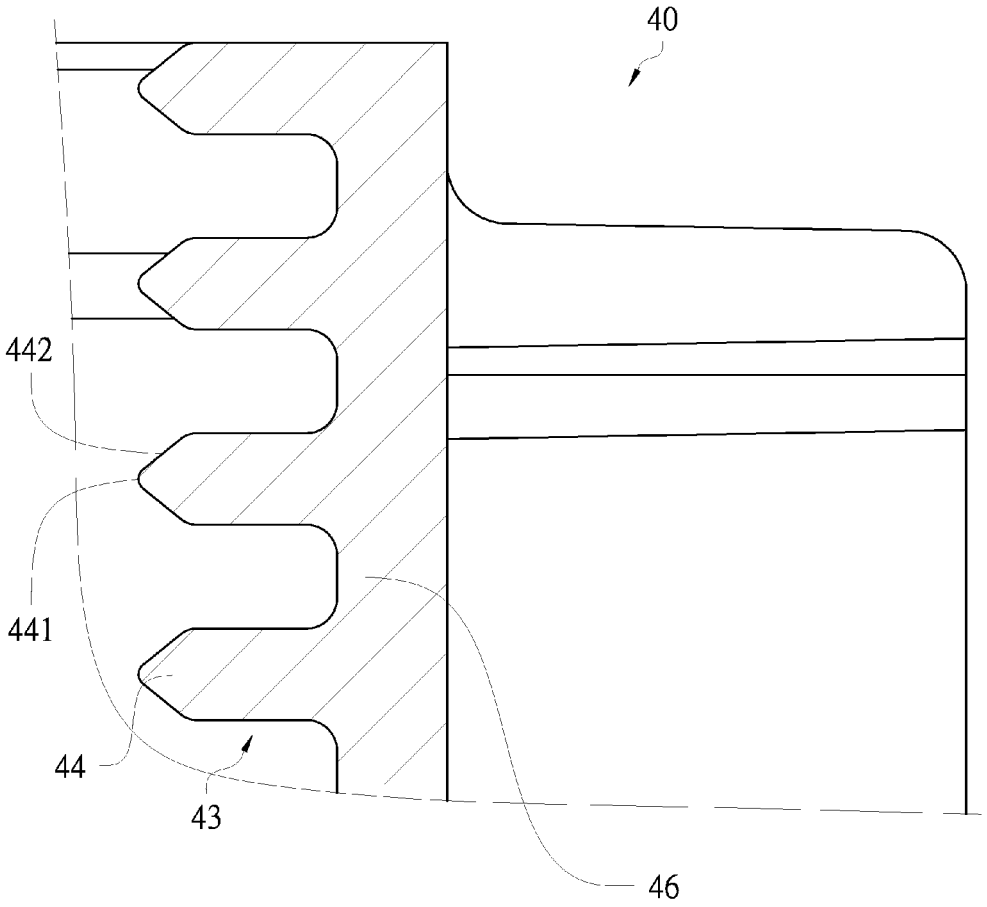
FIG. 8 is an amplified cross-sectional view showing the assembly of a positioning tooth of the driving bock according to the preferred embodiment of the present invention.

The driving block 40 includes a pressing portion 41 secured on one end thereof and extending out of the orifice 32 of the outer tube 30, two flanges 42 extending outwardly from two sides of the pressing portion 41 and corresponding to the two toothed racks 22, plural positioning teeth 43 disposed on two sides of the two flanges 42 and engaging with the plurality of guide teeth 23, wherein a number of the plural positioning teeth 43 is less than that of the plurality of guide teeth 23. The driving block 40 also includes a trench 47 defined thereon, each positioning tooth 43 has a second crown portion 44, a second root portion 45 extending between a top end and a bottom end thereof, and a second bottom face 46, wherein the second root portion 45 has two second arcuate sections extending outwardly from two sides of a bottom end thereof, as shown in FIGS. 4 and 8, the second crown portion 44 has a top face 441 in an arc shape, and the second crown portion 44 has two second tilted faces 442 extending on two sides thereof. A height a (i.e., a distance from a tip of the second crown portion 44 to a bottom end of the second crown portion 44) of the second crown portion 44 is 1 mm, a height b of the second root portion 45 is 3 mm, a depth h of each positioning tooth 43 is 4 mm. Preferably, a pitch between any two positioning teeth 43 is within 2.2 mm to 5 mm.

The fixing member 50 is accommodated in the inner tube 10 and includes a first segment 51 and a second segment 52, wherein the first segment 51 is inserted through the elongated hole 13 of the inner tube 10 to retain in a second end of the outer tube 30 opposite to the second end of the outer tube 30, and the second segment 52 is fitted in the trench 47 of the driving block 40 and has a trough 53 defined therein.

The resilient element 60 is fixed in the inner tube 10 and has a first end inserted into the trench 47 of the driving block 40 and a second end fitted into the trough 53 of the fixing member 50. The resilient element 60 is a compression spring, and between the fixing member 50 and the trench 47 is defined a compressing space 61 which is larger than or equal to the depth h of each positioning tooth 43.

Figure 5:
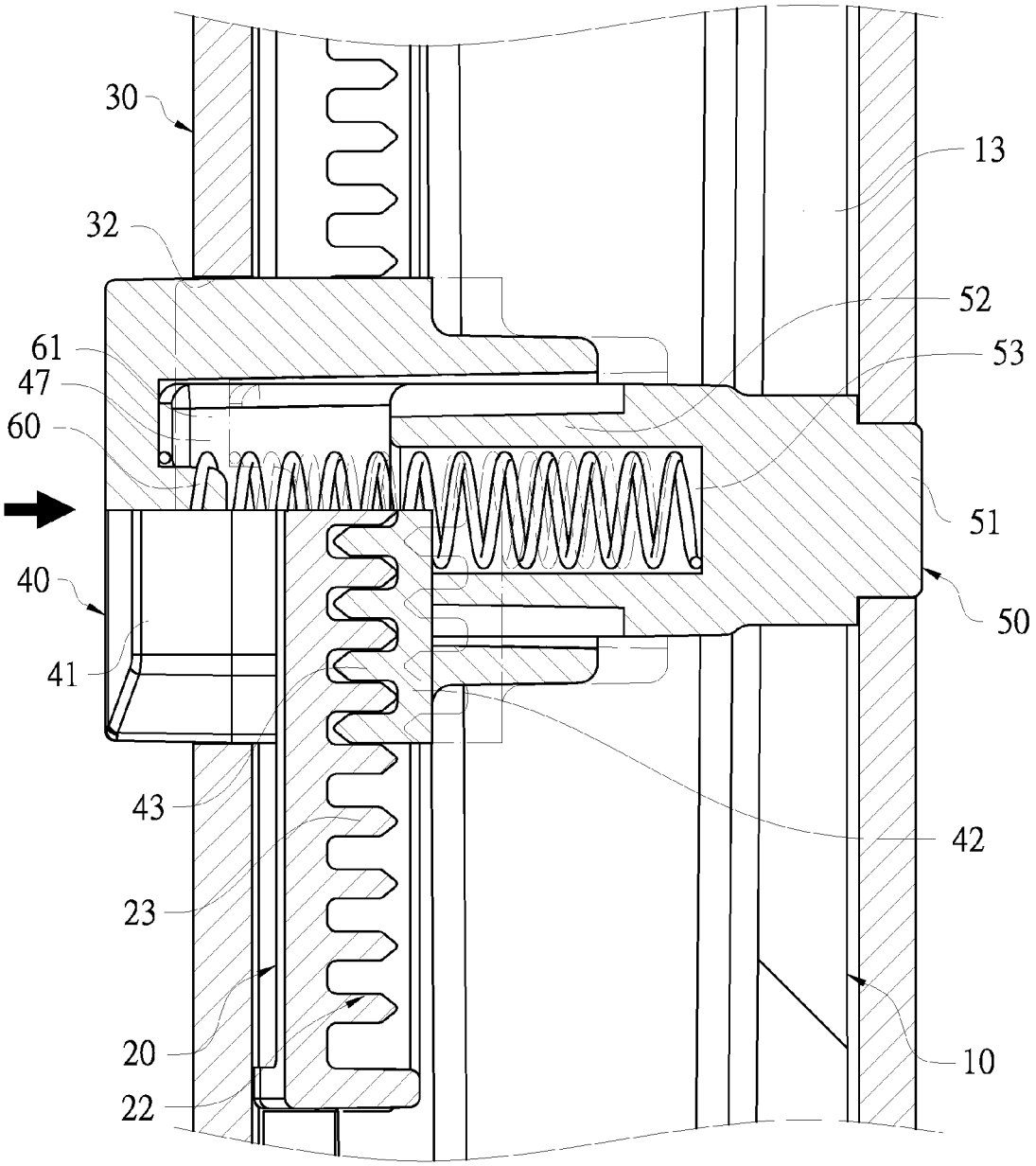
FIG. 5 is a cross sectional view showing the operation of the height adjustment mechanism for the chair armrest and the driving block thereof according to the preferred embodiment of the present invention.
Figure 6:
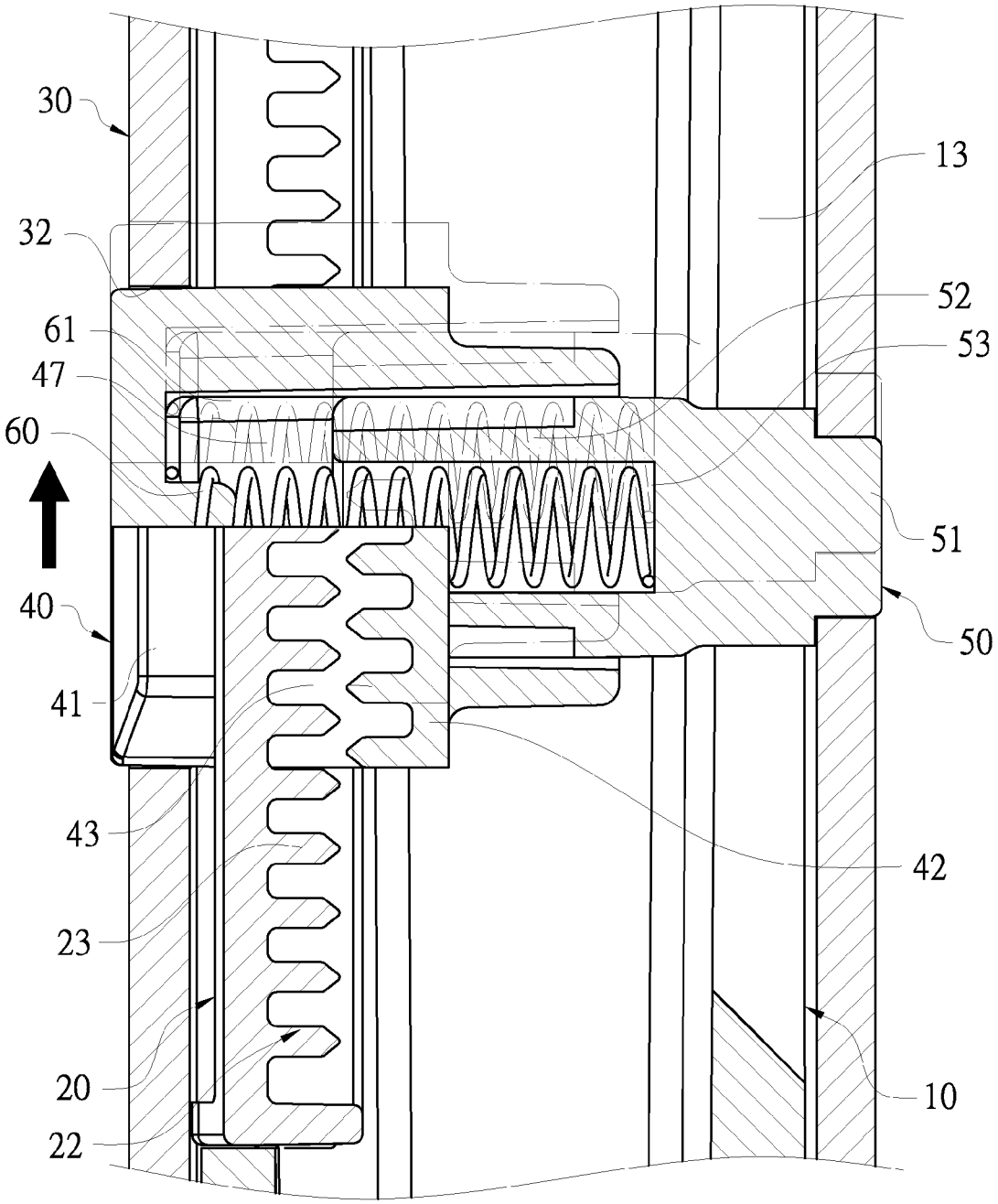
FIG. 6 is another cross sectional view showing the operation of the height adjustment mechanism for the chair armrest and the driving block thereof according to the preferred embodiment of the present invention.
Figure 7:
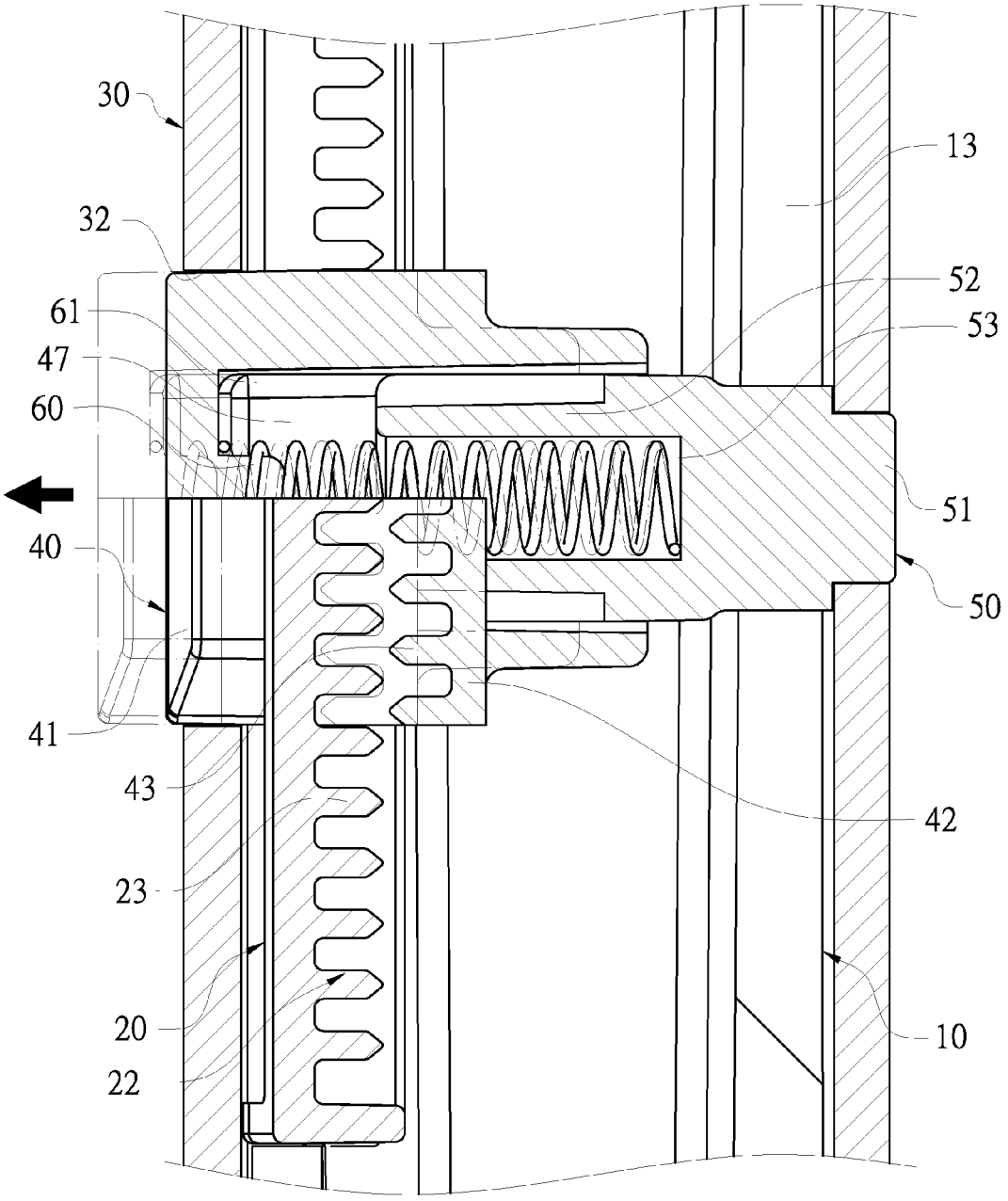
FIG. 7 is also another cross sectional view showing the operation of the height adjustment mechanism for the chair armrest and the driving block thereof according to the preferred embodiment of the present invention.

In operation, as illustrated in FIGS. 3 and 5, the pressing portion 41 of the driving block 40 is pressed so that the driving block 40 moves toward the fixing member 50 to shorten the compressing space 61 and to press the resilient element 60, such that the plural positioning teeth 43 remove from the plurality of guide teeth 23. Referring further to FIG. 6, the outer tube 30 is moved upwardly or downwardly along the guiding slot 21 of the adjusting member 20, thus adjusting the support plate 31 toward a desired height. As illustrated in FIG. 7, after releasing the driving block 40, it is pushed by the resilient element 60 to move away from the fixing member 50, hence the plural positioning teeth 43 of the driving block engage with the plurality of guide teeth 23 of the adjusting member 20, thus fixing the support plate 31 at the desired height easily and quickly.

Accordingly, the chair armrest is adjusted to the desired height smoothly by ways of the second crown portion 44 of the driving block 40 and the plurality of guide teeth 23 of the adjusting member 20. Furthermore, the chair armrest is adjusted in a stepless adjusting manner. Preferably, the plural positioning teeth 43 of the driving block 40 engage with the plurality of guide teeth 23 of the adjusting member 20 to enhance locking strength.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A height adjustment mechanism for a chair armrest comprising:

an inner tube including a base disposed on a bottom end thereof, an accommodating groove longitudinally defined on a first side thereof, and an elongated hole vertically formed on a second side thereof;

an adjusting member mounted in the accommodating groove of the inner tube and including a guiding slot longitudinally arranged thereon, two toothed racks formed on two sides of the guiding slot, and a plurality of guide teeth arranged on the two toothed racks, wherein each guide tooth has a first crown portion defined on a top end thereof and formed in an arc shape, a first root portion extending between the top end and a bottom end of each guide tooth, and a first bottom face arranged on the bottom end thereof, wherein the first root portion of each guide tooth has two first arcuate sections extending outwardly from two sides of a bottom end thereof, and the first crown portion of each guide tooth has two first angled faces extending on two sides thereof;

an outer tube fitted on the inner tube and including a support plate fixed on a top end thereof and an orifice formed on a first side thereof;

a driving block including a pressing portion secured on one end thereof and extending out of the orifice of the outer tube, two flanges extending outwardly from two sides of the pressing portion and corresponding to the two toothed racks, and plural positioning teeth disposed on the sides of the two flanges facing and engaging with the plurality of guide teeth, wherein a number of the plural positioning teeth is less than that of the plurality of guide teeth, each positioning tooth has a second crown portion, a second root portion extending between a top end and a bottom end thereof, and a second bottom face, and wherein the second root portion has two second arcuate sections extending outwardly from two sides of a bottom end thereof, the second crown portion has a top face in an arc shape, and the second crown portion has two second angled faces extending on two sides thereof;

a fixing member accommodated in the inner tube and including a first segment and a second segment, wherein the first segment is inserted through the elongated hole of the inner tube to retain in a second end of the outer tube opposite to the second end of the outer tube;

a resilient element fixed in the inner tube and including a first end and a second end which abut against the driving block and the fixing member, wherein between the fixing member and the driving block is defined a compressing space which is larger than or equal to a depth of each positioning tooth.

2. The height adjustment mechanism for the chair armrest as claimed in claim 1, wherein the driving block also includes a trench defined thereon, the second segment of the fixing member is fitted in the trench of the driving block and has a trough defined therein, the first end of the resilient element is inserted into the trench of the driving block, and the second end of the resilient element is fitted into the trough of the fixing member.

3. The height adjustment mechanism for the chair armrest as claimed in claim 1, wherein a pitch between any two positioning teeth is within 2.2 mm to 5 mm.

4. A driving block comprising a pressing portion secured on one end thereof, two flanges extending outwardly from two sides of the pressing portion, plural positioning teeth disposed on the sides of the two flanges facing and engaging the teeth sides on an adjusting member while said driving block is secured to a fixing member such that the teeth of said driving block are adapted to releasably engage the teethed adjusting member to provide adjustability therebetween, wherein each positioning tooth has a crown portion, a root portion extending between a top end and a bottom end thereof, and a bottom face, wherein the root portion has two arcuate sections extending outwardly from two sides of a bottom end thereof, the crown portion has a top face in an arc shape, and the crown portion has two angled faces extending on two sides thereof, wherein a height of the root portion is 3 mm, a depth of each positioning tooth is 4 mm, and a pitch between any two positioning teeth is within 2.2 mm to 5 mm.

* * * * *